US007217231B2

(12) United States Patent
Hensen

(10) Patent No.: US 7,217,231 B2
(45) **Date of Patent: *May 15, 2007**

(54) DEVICE FOR SEALING SPOUTS IN POUCHES

(75) Inventor: Henno Hensen, Bremen (DE)

(73) Assignee: Fresenius Kabi Deutschland GmbH, Frankfurt (DE)

( * ) Notice: Subject to any disclaimer, the term of this patent is extended or adjusted under 35 U.S.C. 154(b) by 200 days.

This patent is subject to a terminal disclaimer.

(21) Appl. No.: 10/488,501

(22) PCT Filed: Sep. 18, 2002

(86) PCT No.: PCT/EP02/10461

§ 371 (c)(1),
(2), (4) Date: Oct. 8, 2004

(87) PCT Pub. No.: WO03/024799

PCT Pub. Date: Mar. 27, 2003

(65) Prior Publication Data

US 2005/0039415 A1 Feb. 24, 2005

(30) Foreign Application Priority Data

Sep. 20, 2001 (DE) ..... 101 46 485

(51) Int. Cl.
*B31B 1/84* (2006.01)

(52) U.S. Cl. ..... 493/87; 493/210; 493/213; 53/133.2

(58) Field of Classification Search ..... 493/87, 493/210, 213; 53/133.1, 133.2
See application file for complete search history.

(56) References Cited

U.S. PATENT DOCUMENTS

| | | | | |
|---|---|---|---|---|
| 3,628,304 | A * | 12/1971 | Hornung | 53/460 |
| 3,868,891 | A | 3/1975 | Parish | |
| 4,512,136 | A | 4/1985 | Christine | |
| 4,601,410 | A * | 7/1986 | Bond | 222/92 |
| 4,718,215 | A | 1/1988 | Carveth et al. | |
| 4,751,806 | A * | 6/1988 | Gram | 53/282 |
| 6,266,948 | B1 * | 7/2001 | Serra | 53/566 |
| 6,347,499 | B1 * | 2/2002 | McGregor et al. | 53/374.9 |
| 6,655,114 | B2 * | 12/2003 | Hiramoto et al. | 53/479 |

FOREIGN PATENT DOCUMENTS

WO WO 95/05317 A1 2/1995

* cited by examiner

*Primary Examiner*—Christopher R. Harmon
(74) *Attorney, Agent, or Firm*—David S. Safran

(57) ABSTRACT

The invention relates to a device for sealing-in pouring spouts in bags (1), comprising at least one station for opening (4) the bag (1), a station for inserting (4) the pouring spout into the opened bag (1), and at least one station for sealing (5, 6, 7) the bag (1) and the pouring spout. According to the invention, such a device is improved with a view to simple design and high processing speed in that the stations (2–8) for bag processing are arranged on a linear transport system (11) for the bags (1), which linear transport system (11) is formed by two transport belts (9, 10), and in that the stations (2–8) for bag processing are all arranged in a grid of equal spacing.

5 Claims, 3 Drawing Sheets

DEVICE FOR SEALING SPOUTS IN POUCHES

Figure 1:
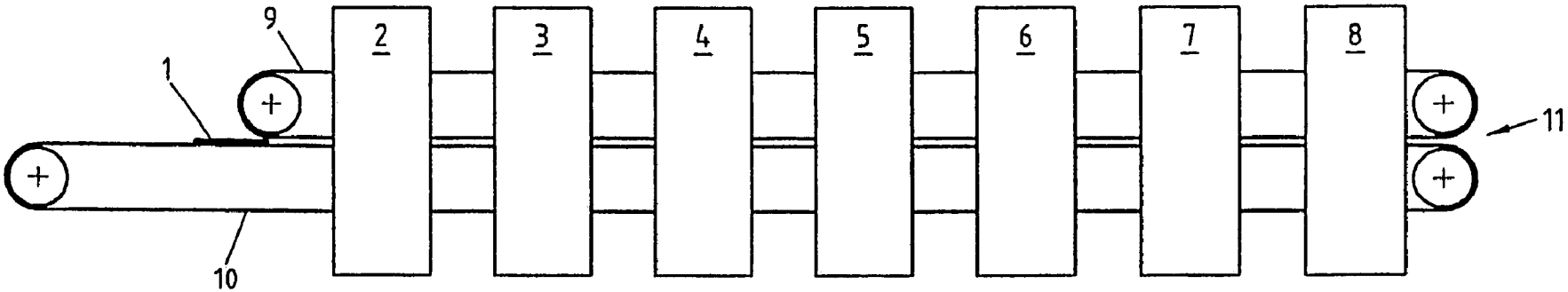

The invention relates to a device for sealing-in pouring spouts in bags, comprising at least one station for opening the bag, a station for inserting the pouring spout into the opened bag, and at least one station for sealing the bag and the pouring spout.

The bags at issue are used for packaging goods which are dischargeable or free-flowing, i.e fillable. As a rule, such bags comprise a multi-layer plastic composite material. Such bags are in particular gaining increased use as butt-ended bags because, due to their flexible outer skin, they offer considerable advantages during transport of the full bags and during disposal of the empty bags.

Sealing-in pouring spouts in such bags is known from the state of the art in a multitude of embodiments. Basically, for sealing-in the pouring spout, the bag may first have to be cut, then opened so as to make it possible to insert the pouring spout into the opening in the bag, wherein after this, the pouring spout, which is then located in the bag opening, is tightly sealed to the bag by means of sealing jaws. As a rule, the devices, known from the state of the art, for sealing-in pouring spouts in bags operate in cycles with the bags in the device being transported on a circuit. Such movement on a circuit is the usual method because as a rule the bags are held by means of grippers, which after picking up and processing the bags have to be transported back to their point of pickup.

Starting from the state of the art as described above, it is the object of the present invention to provide a device for sealing-in pouring spouts in bags, with which device pouring spouts can be sealed into bags at a high cycle speed with very modest equipment-related expenditure.

According to the invention, the above-derived and shown object is met in that the stations for bag processing are arranged on a linear transport system for the bags, which linear transport system is formed by two transport belts, and in that the stations for bag processing are all arranged in a grid of equal spacing. The design according to the invention of a device for sealing-in pouring spouts ensures that bag transport between the stations for bag processing is achieved with very modest mechanical expenditure at a high transport speed and cycle speed.

In a first advantageous embodiment of the device according to the invention, the transport belts are toothed belts. Using toothed belts as transport belts ensures precise positioning even at high transport speeds and cycle speeds since there is no possibility of slippage occurring between the drive and the transport belts.

At the same time, the use of toothed belts ensures excellent positioning accuracy of the bags relative to the stations for bag processing.

Providing a step motor for cycled driving of the transport belts, due to the design principle of a step motor, ensures the attainment of excellent positioning accuracy while at the same time achieving excellent acceleration of the transport belts.

Figure 2:
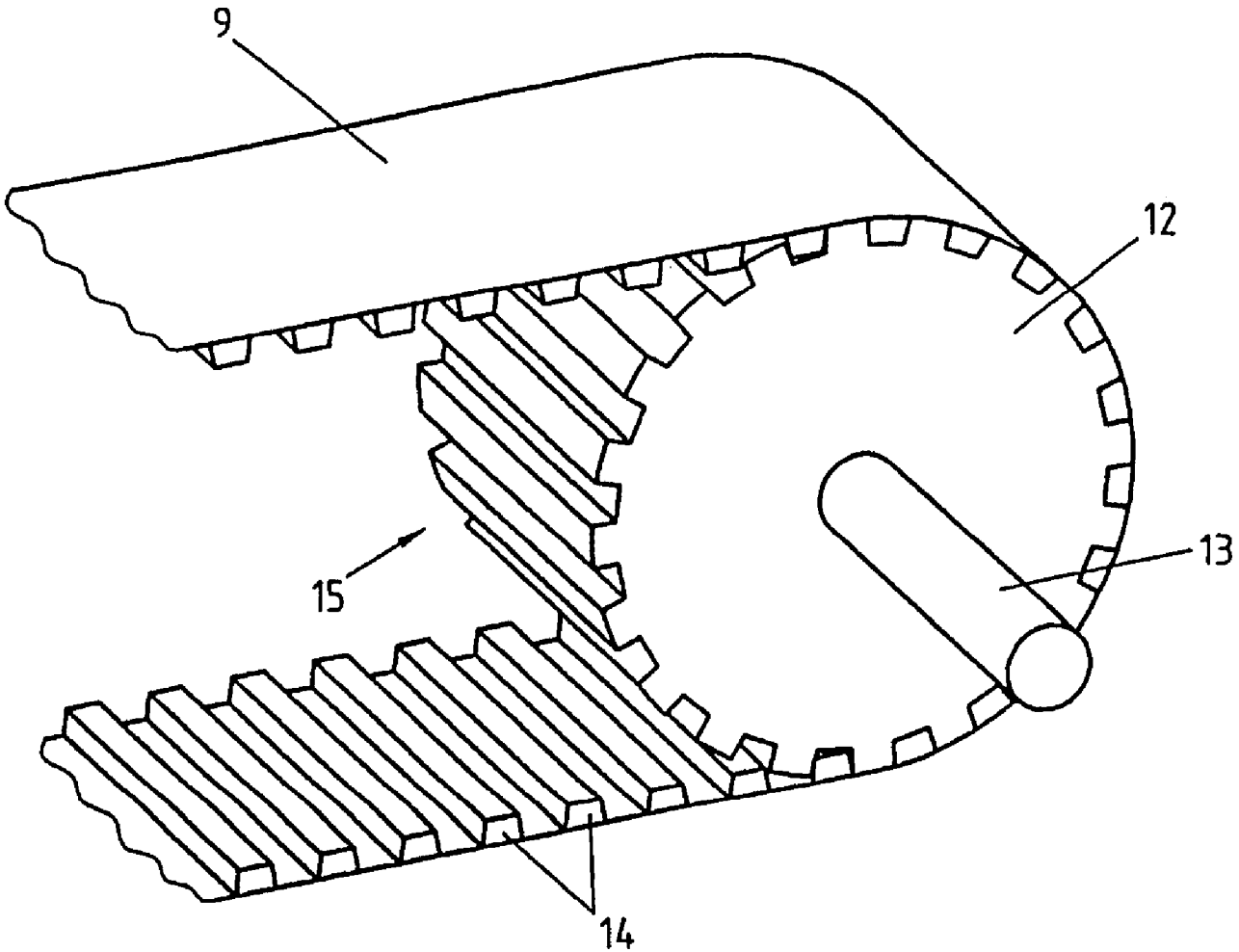
Figure 3:
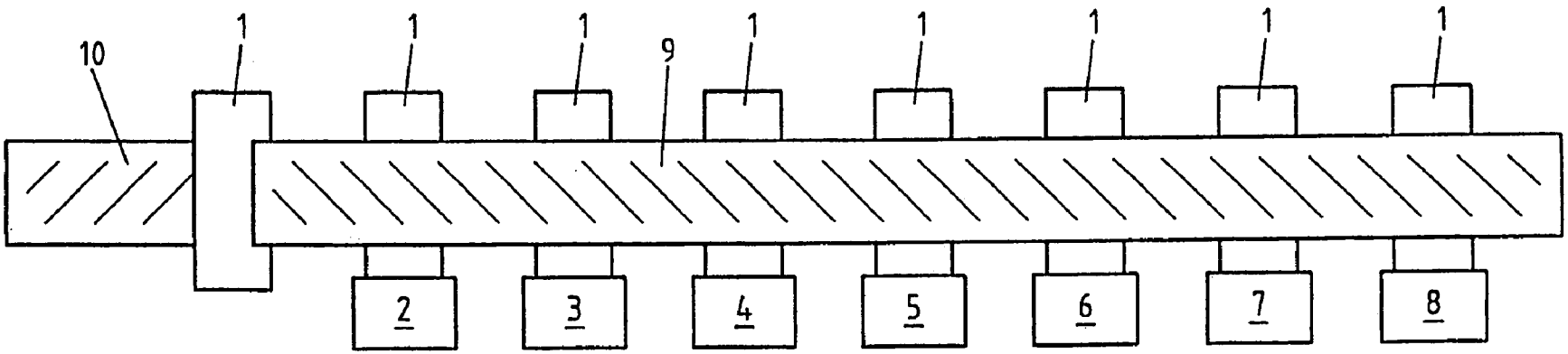

There are now a multitude of options for designing and improving the device according to the invention for sealing-in pouring spouts in bags. In this context we refer for example not only to the subordinate claims of claim 1, but also to the description of a preferred embodiment in conjunction with the drawing. The drawing shows the following:

FIG. 1 a lateral view of an embodiment of a device according to the invention for sealing-in pouring spouts in bags, FIG. 2 a close-up view of the drive of a transport belt of the embodiment of the device according to the invention; and FIG. 3 a top view of the embodiment of a device according to the invention.

The embodiment shown in FIG. 1 of a device according to the invention for sealing-in pouring spouts in bags 1 comprises a station for cutting 2, a station for preliminary opening 3 by initial blowing of hot air into the bag aperture, a station for opening and inserting 4 the pouring spouts which are not shown in FIG. 1, three stations for sealing 5, 6, 7, and a station for cooling 8 the seal connection between a bag 1 and a pouring spout, the latter not shown.

According to the invention, the above-described stations 2–8 for bag processing are arranged on a linear transport system 11 for the bags 1, which linear transport system 11 is formed by two transport belts 9, 10, wherein the stations 2–8 for bag processing are all arranged with equal spacing from the adjacent station in order to ensure, during cycled movement of the bags 1 in the linear transport system 11, that the bags are in a processing position when the linear transport system 11 comes to a halt. Of course, it is also imaginable to render one station or several on the linear transport system inoperative or to do entirely without it/them, as long as the stations for processing are arranged in a grid of equal spacing, if the respective processing step, for example the cutting of bags, is not required.

FIG. 2 of the drawing shows one of the transport belts 9, which rests on a drive roller 12, with said drive roller being driven, via a shaft 13, by a step motor which is not shown. Particularly preferably, the second transport belt 10 is driven by means of the same step motor and at the same speed with opposite direction of rotation, by way of a gear arrangement which is also not shown.

The teeth 14 of the transport belt 9 and the tooth arrangement 15 of the drive roller 12 ensure that the transport belt 9 can be driven by the drive roller 12 without there being any slippage.

FIG. 3 shows a top view of the embodiment, which in particular clearly shows how the bags 1 are picked up between the lower transport belt 10 and the upper transport belt 9.

The invention claimed is:

1. A device for sealing-in pouring spouts in bags (1), comprising station for opening (4) the bag (1), a station for inserting (4) the pouring spout into the opened bags (1), and at least one station for sealing (5, 6, 7) the bag (1) and the pouring spout, characterised in that the stations (2–8) for bag processing are arranged on a linear transport system (11) for the bags (1), which linear transport system (11) is formed by two transport belts (9, 10), and in that the stations (2–8) for bag processing are all arranged in a grid of equal spacing.

2. The device according to claim 1, characterised in that the transport belts (9, 10) are toothed belts.

3. The device according to claim 1, characterised in that a step motor is provided for cycled driving of the transport belts (9, 10).

4. The device according to claim 2, characterised in that a step motor is provided for cycled driving of the transport belts (9, 10).

5. The device according to claim 1, wherein the transport belts have horizontally oriented conveying surfaces.

* * * * *